US006419421B1

(12) United States Patent
Whitfield, Jr.

(10) Patent No.: US 6,419,421 B1
(45) Date of Patent: Jul. 16, 2002

(54) APPARATUS FOR DRAINING LAND AREAS WITH AN ADJUSTABLE SYSTEM FOR GRAVITY FLOW

(76) Inventor: William E. Whitfield, Jr., 4074 Canal Dr., Mobile, AL (US) 36619

( * ) Notice: Subject to any disclaimer, the term of this patent is extended or adjusted under 35 U.S.C. 154(b) by 0 days.

(21) Appl. No.: 08/920,257

(22) Filed: Feb. 4, 1999

(51) Int. Cl.[7] ..... E02B 13/00

(52) U.S. Cl. ..... 405/36; 405/40; 405/52; 52/20; 52/169.7; 210/170

(58) Field of Search ..... 405/36, 39, 40, 405/41, 51, 53, 74, 116, 117, 124, 125; 52/19, 20, 169.7, 169.8; 220/565, 584, 628; 404/2, 3, 4, 5, 25; 210/170, 163, 164, 747

(56) References Cited

U.S. PATENT DOCUMENTS 3,263,378 A * 8/1966 Dorris ..... 404/25 X
3,562,969 A * 2/1971 Little, Jr. ..... 404/4 X
3,695,153 A * 10/1972 Dorris ..... 404/4
3,982,777 A * 9/1976 Martin ..... 285/192
4,136,010 A * 1/1979 Pilie et al. ..... 210/164
4,298,471 A * 11/1981 Stallings ..... 210/170
4,345,998 A * 8/1982 Graffis et al. ..... 404/4 X
4,663,036 A * 5/1987 Strobl, Jr. et al. ..... 210/170
4,756,827 A * 7/1988 Mayer ..... 210/170
4,838,731 A * 6/1989 Gavin ..... 405/40
4,919,568 A * 4/1990 Hurley ..... 405/43
4,988,235 A * 1/1991 Hurley ..... 405/36 X
5,154,353 A * 10/1992 Plachy ..... 405/36 X
5,569,372 A * 10/1996 Smith ..... 404/25 X
5,617,679 A * 4/1997 Meyers ..... 405/41 X
5,772,361 A * 6/1998 Gavin ..... 405/36
5,791,098 A * 8/1998 Thomas ..... 52/169.6

* cited by examiner

*Primary Examiner*—Heather Shackelford
*Assistant Examiner*—Jong-Suk Lee

(57) ABSTRACT

A plastic catch basin with grate on top, box shape design to drain a low area by gravity to a final drain area through plastic pipes, the catch basin to be assembled on site according to need by constructing with side plates with a choice of holes according to need and the catch basin is designed to be more solidly constructed to hold its shape over time and use, constructed to be modified by adding additional catch basins with the plastic pipes as need arises.

2 Claims, 3 Drawing Sheets

UNIT VIEW

UNIT VIEW

Top Unit

Bottom Piece

Corner Piece

Side Plate W/ Holes

Side Piece

APPARATUS FOR DRAINING LAND AREAS WITH AN ADJUSTABLE SYSTEM FOR GRAVITY FLOW

BACKGROUND OF THE INVENTION

1. Field of the Invention

This present invention relates to drainage for land areas More specifically, this invention relates to a system of drainage from one plastic receptacle, termed "catch basin," to another catch basin through plastic pipes and to a final drain area such as a lake, river, ditch, etc. This invention can be constructed with some flexibility and is designed to be substantial in construction to eliminate the possibility of corruption (distortion of original size and design) which may occur with some catch basins over time and usage.

2. Description of the Related Art

This invention consists of various plastic parts assembled into a "box-like" catch basin to drain low land areas by gravity through a plastic pipe to a final drain area. It is constructed with a bottom, top (fitted grate), sides and comer pieces into a substantial catch basin to be incorporated into a system of drainage from one catch basin to another by plastic pipes through the proper assembling of various choices of the side pieces in the catch basin chosen according to the slope of the drainage pipe from one catch basin to the other.

The catch basin can be packed and shipped in a small cubic area to be assemble, on site. The catch basin can be constructed in various sizes according to the drainage problem.

BRIEF SUMMARY OF THE INVENTION

This invention has a bottom, a top, four side walls and four corner pieces. The bottom is constructed to bold the comer pieces in each of the four corners, The top is constructed to hold the comer pieces in place in each corner on the top. The top is constructed with a recess to receive a grate fitted to set into the recess. Prior to placing the top on the corner pieces, the selected side walls are placed into the corner pieces which have a groove up and down the corner piece on two sides which holds the side walls in place. The top is fitted over the corner pieces which holds the side walls in place. This unit is placed into the ground, the top to be about one inch below ground level to allow the water to drain into the catch basin through the top and to drain and to exit the catch basin in a plastic drain pipe on the side to another catch basin or to the final drain area.

One aspect of this invention is the flexible construction of the catch basin to arranged into connected catch basins by plastic pipes to drain several low land areas with the placed catch basins and then to a final drain area. One catch basin is to be placed in a low land drain area. The plastic drain pipe will exit a selected side piece with the exiting hole in the top level of the side plate. The drain pipe can be shaped to drain by gravity to the next catch basin into a selected side plate with the hole in the middle or bottom. From this catch basin another side piece can be selected with an exiting hole in the top level, the drain pipe will exit this catch basin and enter the bottom hole in the side plate of another catch basin. From this catch basin the exiting plastic pipe will exit from the top hole in the side wall and go to the final drain area.

Another aspect of the invention is that later additional catch basins can be added and existing catch basins can be modified to receive additional drain pipes coming from catch basins from other low land areas to drain through to the final drain area.

BRIEF DESCRIPTION OF THE SEVERAL VIEWS OF THE DRAWING(S)

DETAILED DESCRIPTION OF THE PREFERRED EMBODIMENT

Figure 1:
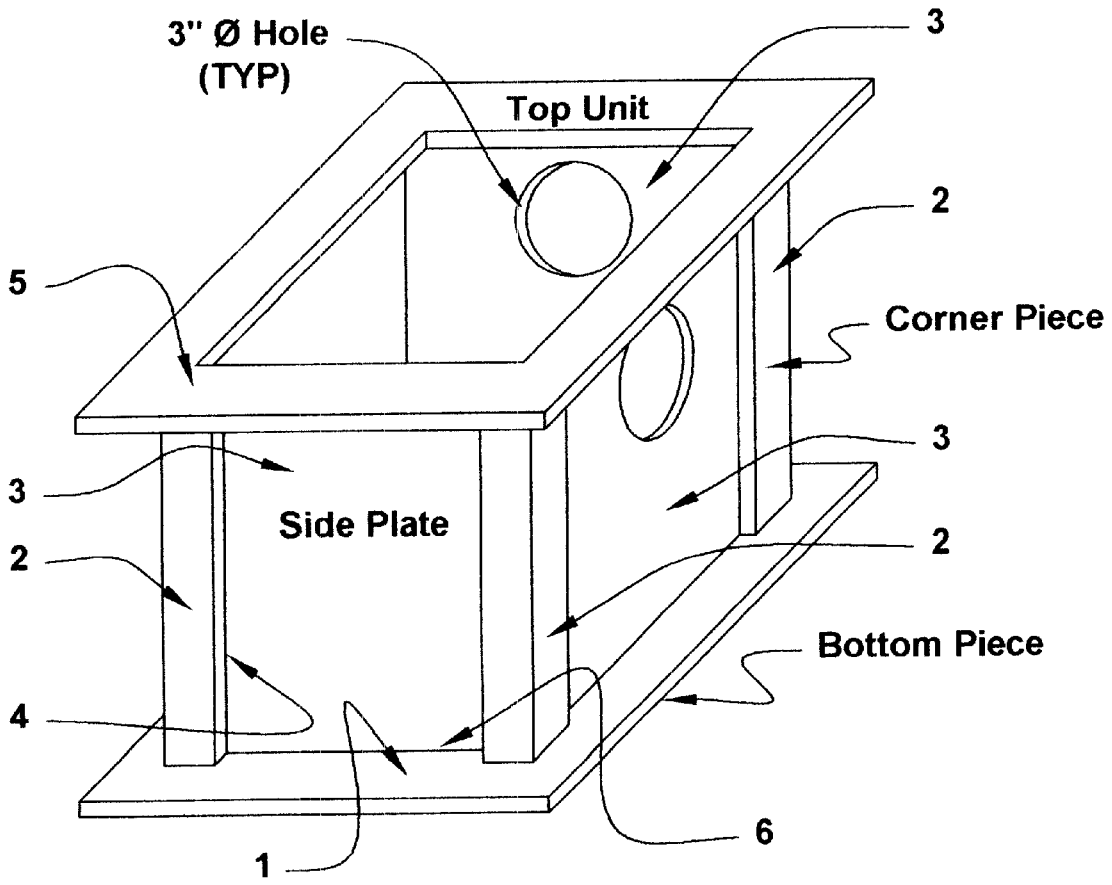
FIG. 1 is a perspective view of the catch basin assembled from previously manufactured plastic pieces, without the drainage grate.
Figure 2:
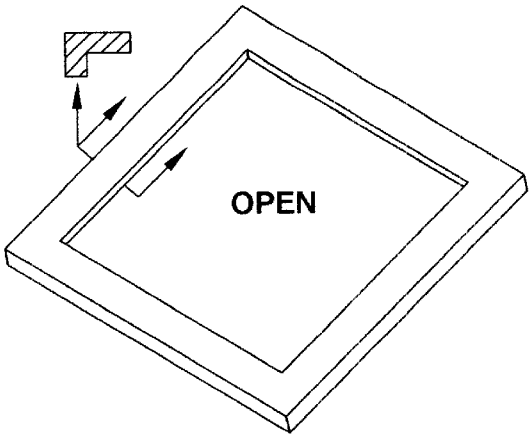
FIG. 2 is an overhead view of the top with the insert showing the underside of the top.
Figure 3:
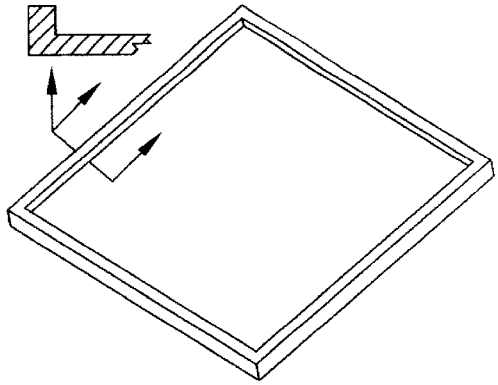
FIG. 3 is a view of the bottom unit with the insert showing the lip around a solid bottom plate.
Figure 4:
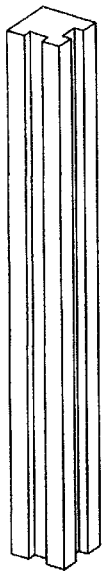
FIG. 4 shows the typical comer piece with a groove going the whole length on two sides, 90 degrees from each other.

The present invention provides a system for draining land areas through the use of a catch basin assembled by various parts as shown in FIG. 1, having a bottom 1 and a top 5 with four comer pieces 2 with grooves 4 that holds the side walls 3.

The solid bottom piece 1 is constructed in a simple manner with a lip or a ledge 6 in order to hold the corner pieces 2 in place. The side walls 3 when inserted in the grooves 4 of the corner piece 2 the comer pieces 2 will be held solidly in place in all four corners of the bottom 1 and by the lip on the underside of top 5.

Figure 5:
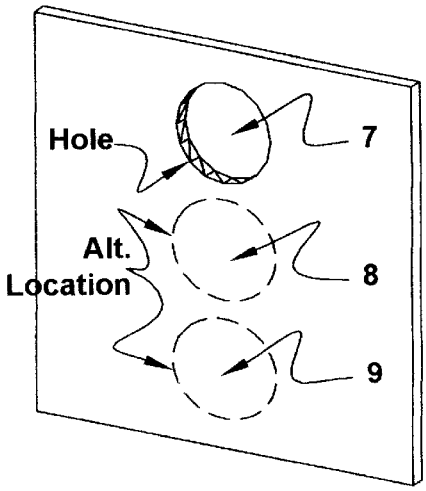
FIG. 5 is a view of a solid side wall with a top hole cut to receive a plastic pipe, and shows the two other alternate hole positions.
Figure 6:
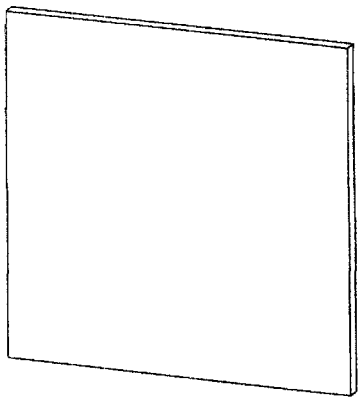
FIG. 6 is a view of a solid side wall.

The side plates as shown in FIG. 5 can be constructed with hole 7 in the upper level of the side wall, with hole 8 in the middle of the side wall, or with the lower level hole 9 in the side wall or the side wall can be selected FIG. 6 with no holes, depending on the placement of the catch basin in the land area that needs to be drained.

Figure 7:
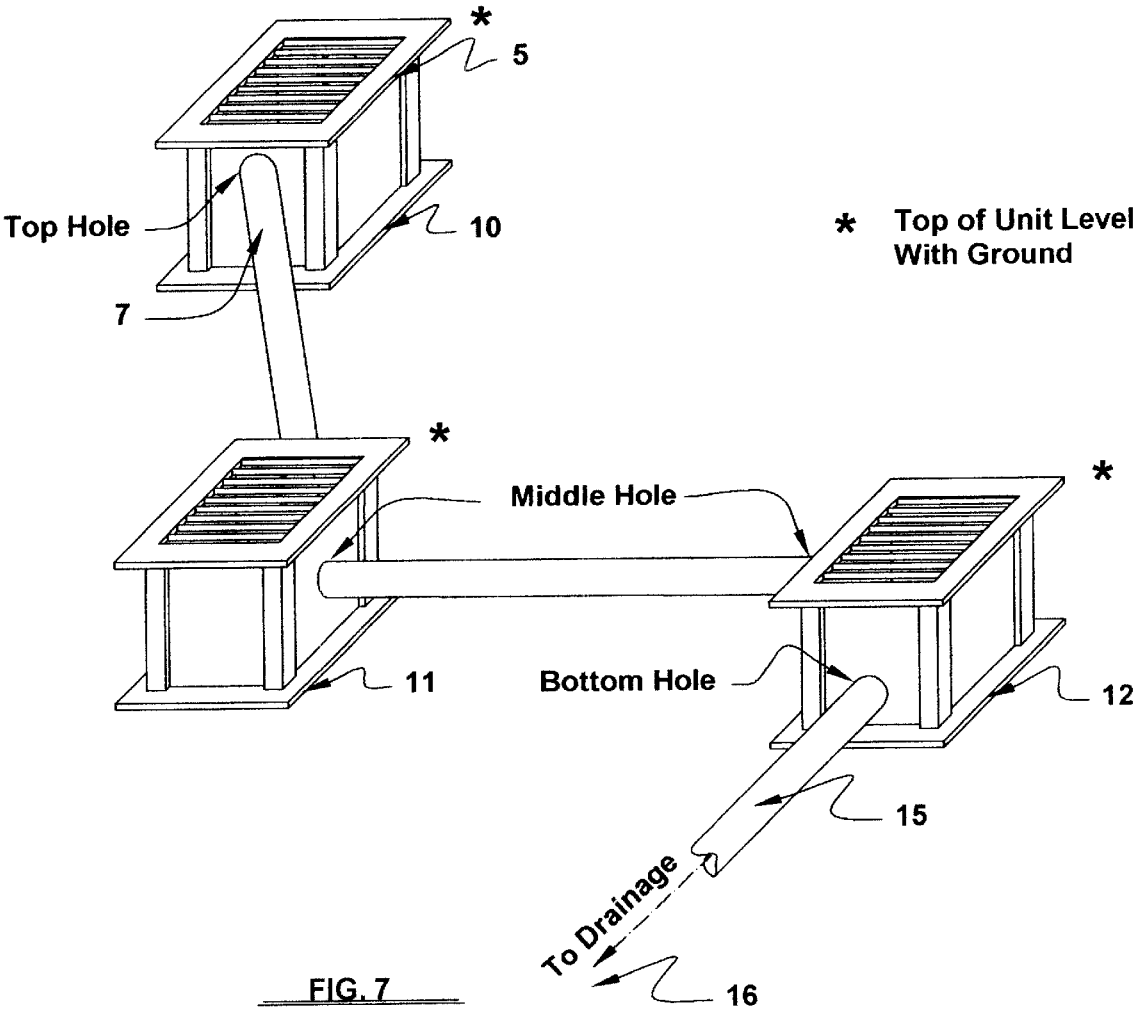
FIG. 7 is a view of three catch basins in a drain sequence from one catch basin to another to the final drain area.

FIG. 7 shows a typical installation of the catch basins in a land area with several low areas that need to be drained. Catch basin 12 is in a low area, the last catch basin in a series of catch basins 10, 11 connected by solid drain pipes 13, 14 with drain pipe 15 going to the final drain area.

For this gravity system to be efficient the final drain area 16 such as a ditch, lake etc., must be lower than the first catch basin 10. Catch basin 10 is implanted in the ground in a low area, the top piece 5 one inch below the level of the ground. Catch basin 11 the second catch basin in the series is implanted in a low area along the direction to catch basin 12 and the final drain area 16. Drain. pipe 13 that exits catch basin 10 and enters catch basin 11 might exit a side plate FIG. 5 upper level hole 7 and enter catch basin 11 in either hole 7, 8, 9, depending upon. the ground level where catch basin. 11 is implanted. Typically the drain pipe would enter catch basin 11 in hole 9 and would exit catch basin 11 through hole 7 by drain pipe 14 and enter catch basin 12 in hole 9. By this method of water exiting catch basin 10 the top hole 7 and going through drain pipe 13 to enter catch basin 11 in the bottom hole 9, there is assured a drop if the land area is fairly level, like a typical back yard of a residential area.

What is claimed is:

1. A plastic catch basin, designed to be assembled on site, comprising of: a top piece, a grate on the top piece, a bottom piece, four side walls having solid side plates, four grooved corner pieces which are held in place by said top and bottom pieces and said side plates, wherein said grooved corner pieces add a solid dimension to the catch basin with holding said side plates together by said top and bottom pieces in a manner to eliminate any distortion of original size and design due to humidity, length of use or pressure of dirt and water, said solid side plates further comprising of drain holes being adjustably made in a desired locations in said side plates in that a drain hole is a top portion of one of said side plates fitted with a plastic drain pipe or a drain hole in a middle portion of said side plate fitted with said plastic drain pipe or a drain hole in a bottom portion of said side plate fitted with said plastic drain pipe, whereby the drain hole in said top or middle portion to drain to a bottom hole in a side wall of an adjacent catch basin to create a gravity flow from said catch basin to said adjacent catch basin.

2. The plastic catch basin, according to claim 1, wherein said side plates can be exchanged with another side plate to receive said plastic drain pipe into said previously implanted catch basin.

* * * * *